US005555954A

United States Patent [19]

Swiderski

[11] Patent Number: 5,555,954

[45] Date of Patent: Sep. 17, 1996

[54] COLLAPSIBLE-EXPANSIBLE SUPPORT ASSEMBLY

[75] Inventor: Paul R. Swiderski, Scott County, Ky.

[73] Assignee: Emerson Electric Co., St. Louis, Mo.

[21] Appl. No.: 283,245

[22] Filed: Jul. 29, 1994

[51] Int. Cl.[6] ..... E04G 1/34

[52] U.S. Cl. ..... 182/152; 182/119

[58] Field of Search ..... 182/152, 178, 182/179, 119, 118

[56] References Cited

U.S. PATENT DOCUMENTS

| | | | |
|---|---|---|---|
| 3,011,586 | 10/1958 | Harvey, Jr. | 182/115 |
| 3,493,208 | 4/1968 | Sato | 248/235 |
| 3,516,425 | 6/1970 | Rigal | 135/45 |
| 3,616,469 | 11/1971 | Injeski | 5/331 |
| 3,858,683 | 1/1975 | Rachocki | 182/156 |
| 4,439,052 | 3/1984 | Wallther | 403/49 |
| 4,534,447 | 8/1985 | Champigny | 182/152 |
| 4,609,071 | 9/1988 | Edwards | 182/152 |
| 5,086,875 | 2/1992 | Shreve | 182/152 |
| 5,099,953 | 3/1992 | Stegath | 182/152 |

*Primary Examiner*—Alvin C. Chin-Shue
*Attorney, Agent, or Firm*—Polster, Lieder, Woodruff & Lucchesi

[57] ABSTRACT

A collapsible-expansible support assembly including a support platform arranged to be supported by spaced ladder frames pivotally joined by a collapsible-expansible truss assembly, adapted to be restrained and automatically locked in shielded outward, expansible movement, the support assembly being mounted on a unique set of casters and plugs.

14 Claims, 4 Drawing Sheets

COLLAPSIBLE-EXPANSIBLE SUPPORT ASSEMBLY

BACKGROUND OF THE INVENTION

The present invention relates to a support assembly and more particularly to a unique and useful construction for a collapsible-expansible rolling scaffold assembly.

Support structures which include two or more pivotally connected structural parts have been long known in the support and scaffolding arts, attention being directed to the pivotal fold-up tower assembly of long since expired U.S. Pat. No. 3,011,586, issued to J. E. Harvey, Jr. on Dec. 5, 1961; to the pivotal support bracket of U.S. Pat. No. 3,493,208, issued to M. Sato on Feb. 3, 1970; to the pivotally collapsible walker assembly of U.S. Pat. No. 3,516,425, issued to W. A. Rigal on Jun. 23, 1970; to the collapsible bed rail structure of U.S. Pat. No. 3,616,469, issued to S. G. Injeski on Nov. 2, 1971; to the boat boarding ladder structure of U.S. Pat. No. 3,858,683, issued to E. Rachocki on Jan. 7, 1975; to the scaffold coupling structure of U.S. Pat. No. 4,439,052, issued to H. Wallther on Mar. 27, 1984; and finally to the collapsible scaffold structure which includes a window and projection structure extending through the window, the window sides limiting relative movement of pivotally connected distal ends of a truss assembly for the scaffold, as shown in U.S. Pat. No. 4,609,071, issued to P. M. Edwards on Sep. 2, 1986.

The present invention provides an improved collapsible-expansible support assembly structure over the prior art structures which inventive structure includes a unique structural support arrangement that is straightforward, efficient and economical to manufacture, assemble and maintain, requiring a minimum of comparatively inexpensive and efficiently operable parts. In addition the support structure of the present invention is comparatively light in weight, readily portable and easily storable, requiring a minimum of space. Further, the support structure of the present invention can be easily and readily erected from a collapsible to an expansible mode and vice versa, at the same time automatically restricting and locking the structure in a preselected, stable position when the mode has been selectively changed. Moreover, the present invention provides a unique, protective shield structure over certain otherwise undesirably exposed areas during mode change and also provides a novel caster assembly and support plank arrangement to further insure support stability. Although the structural features of the present invention, including the facility of assembly to each other of vertical and horizontal structural members have particular uniqueness in the scaffolding arts, it is to be understood that many of the novel structural features disclosed herein can be of significant use in other structural support arrangements.

Various other features of the present invention will become obvious to one skilled in the art upon reading the disclosure set forth herein.

BRIEF SUMMARY OF THE INVENTION

More particularly, the present invention provides a collapsible-expansible support assembly comprising:

a pair of vertically extending spaced rung ladder frames, the ladder frames being adapted to be moved apart in expanded spaced substantially parallel relation so that the rungs thereof can receive at least one support platform to be mounted thereon; a movable collapsible-expansible truss assembly including opposed spaced remote distal ends pivotally mounted respectively to the ladder frames and adjacent proximal ends pivotally joined to each other; and, restricting and holding means cooperative with the joined proximal ends to automatically releasably lock and immobilize the collapsible-expansible truss assembly when the truss assembly has been moved to such preselected position.

It is to be understood that various changes can be made by one skilled in the art in one or more of the several parts of the structure disclosed herein without departing from the scope or spirit of the present invention. It further is to be understood that one or more of the inventive features described herein are not to be considered as limited to the scaffold art as illustrated but can be effectively utilized in other support structure arts besides scaffolding.

BRIEF DESCRIPTION OF THE DRAWINGS

Referring to the drawings which disclose one advantageous embodiment of the present invention and a modification to one of the features thereof.

DETAILED DESCRIPTION OF THE DRAWINGS

Figure 1:
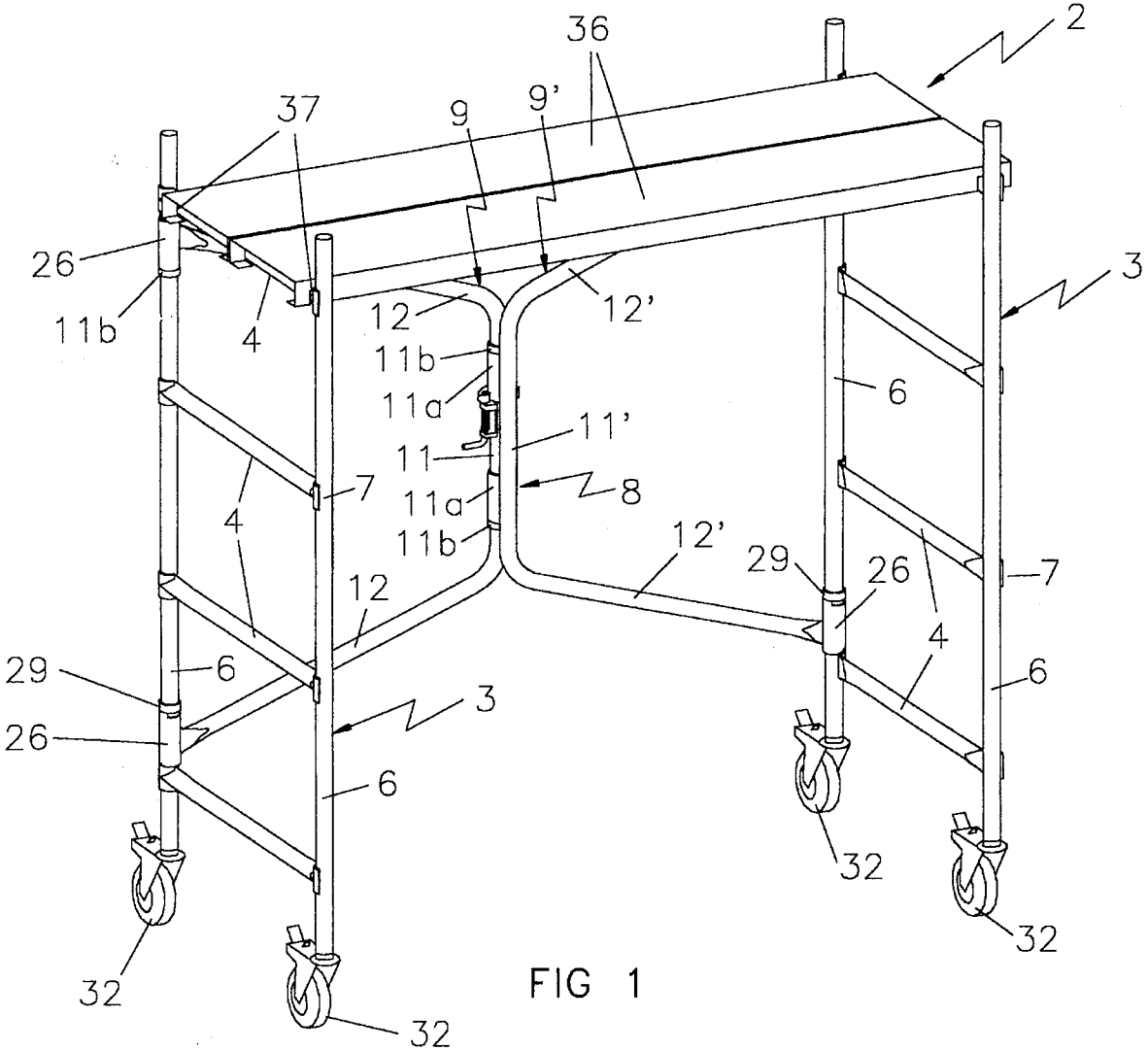
FIG. 1 is an isometric view of an expanded mini-type scaffold incorporating the several features of the present invention and including side-by-side support platform planks.

Referring to FIG. 1 of the drawings, a mini-scaffold support assembly 2 is disclosed which incorporates the several novel features of the present invention. As above mentioned, these features, which will be described in detail hereinafter, are not to be considered as limited only to the scaffold structure as disclosed but also can be effectively utilized in a number of other types of support structures as well.

The scaffold assembly 2 is of a type which is collapsible-expansible and includes a pair of vertically extending rung ladder frames 3, each frame 3 including a set of spaced horizontally extending tubular rungs 4 and a pair of spaced, vertically extending uprights 6. In the interest of both decreasing weight and, at the same time, maximizing strength, the rungs 4 and uprights 6 can be suitably formed from hollow, tubular metallic or equivalent material with opposed extremities 7 of each rung 4 being of arc-like shape form to each conform with and overlap a portion of the peripheral surface of an upright 6 to be suitably joined thereto by welding. Extending between rung ladder frames 3 is a moveable collapsible-expansible truss assembly 8 which also can be made from hollow, light weight, strong metallic or equivalent tubing. Truss assembly 8 includes a pair of corresponding, mirror-imagine related substantially U-shaped hollow tubular frame members 9, and 9'. Each mirror-image related hollow tubular frame member 9 and 9' of truss assembly 8 includes base leg 11 and 11' respectively which serve as the proximal ends thereof with opposed legs 12 and 12' of each frame 9 and 9' extending outwardly at a suitable angle from the extremities of base leg 11 and 11' respectively.

Figure 7A:
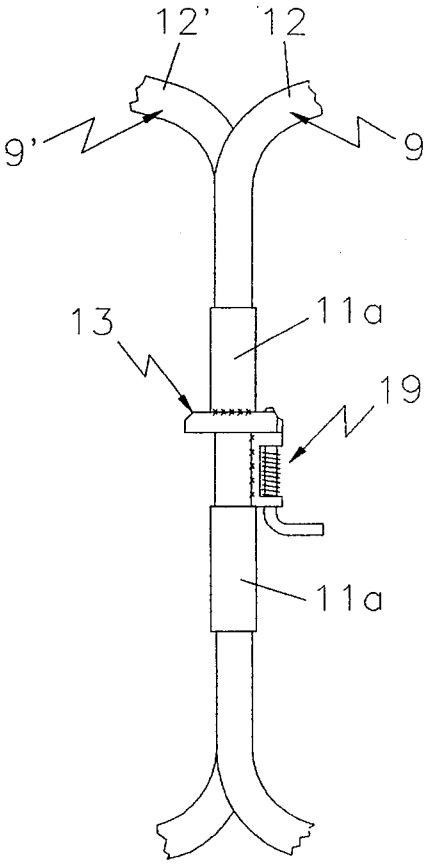
FIG. 7*a* is a side view of a modified embodiment of the structure disclosed in FIG. 7.

In accordance with one feature of the present invention, it is to be noted that the proximal end base legs 11 and 11' of U-shaped truss frame members 9 and 9' respectively are positioned to be adjacent and pivotal relative each other. This is accomplished through spaced pivot tubes 11*a* which pivots tubes 11*a* are fastened to the periphery of base leg 11' of truss frame member 9'. These spaced pivot tubes 11*a* pivotally receive base leg 11 of truss frame 9. Pivot tubes 11*a* are limited in possible linear movement by retaining rings 11*b* welded to base leg 11 adjacent tubes 11*a*. It is to be understood that the spacing and linear limitations can be accomplished by other structural arrangements. For example in FIG. 7*a*, the spacing between the pivot tubes 11*a* is less with possible linear movement being limited by the cooperating track member 13 and support bracket 19 as described more fully herein without use of retaining rings 11*b*. In this regard, attention further is directed to the enlarged views disclosed in FIGS. 5–7*a* of the drawings. In these figures, it can be seen that base leg 11 of truss frame member 9 cooperates with a semi-spherical cast metallic track member 13 of U-shaped cross-section with one of the two spaced semi-spherical outer legs 14 of track member 13 being shaped to conform with and be fastened to one of the pivot tubes 11*a* with semi-spherical base 16 of track member 13 resting in a horizontal plane. The pivot tube 11*a*, as aforedescribed, is fixed to the periphery of base leg 11' of truss frame member 9' and pivotally receives base leg 11 of truss member 9. As can be particularly seen in FIG. 7, semi-spherical base leg 16 of track member 13 includes at least one aperture 17 at one extremity thereof and can further include an aperture 40 at the opposite extremity with the spaced outer semi-spherical track legs 14 extending therefrom. These spaced outer legs 14 serve as a guide track for a pin end follower mounted on adjacent proximal end base leg 11 of truss frame member 9, as described hereinafter.

Figure 7:
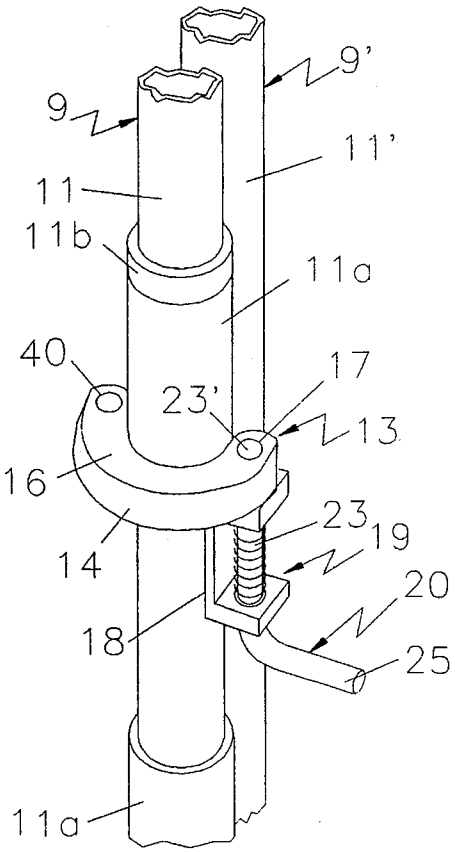
FIG. 7 is still another enlarged, exploded isometric view from an above position of the restricting and holding means structure of FIGS. 5 and 6.
Figure 6:
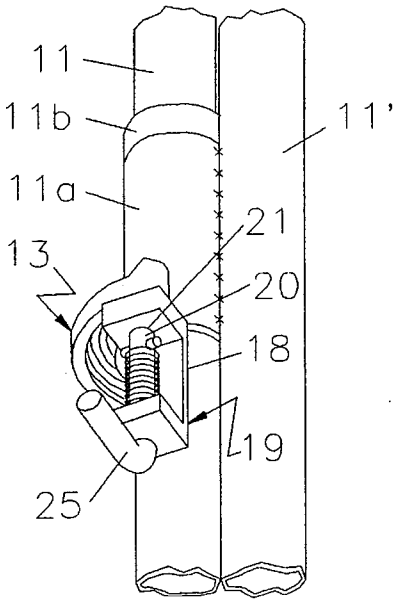
FIG. 6 is another enlarged, exploded, isometric view from an underside position of the novel restricting and holding means structure of FIG. 5 in assembled relation with the proximal ends of the truss assembly.
Figure 5:
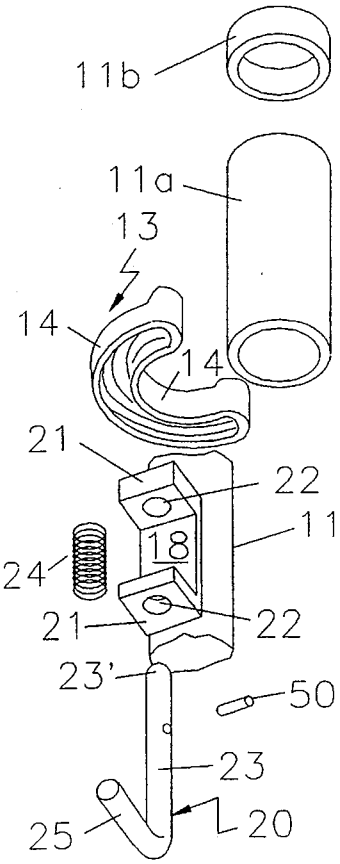
FIG. 5 is an enlarged exploded, isometric view from an underside position of the novel restricting and holding means of the present invention as it would be associated with to be joined distal ends of the inventive truss assembly.

As also can be seen more clearly in FIGS. 5–7 of the drawings, the proximal end base leg 11 of truss frame member 9 has fixed thereto the base leg 18 of a U-shaped spring-loaded pin support bracket 19. The normally extending spaced outer legs 21 of support bracket 19 which are integral with bracket base leg 18, each include one of a pair of spaced aligned apertures 22. These spaced aligned apertures 22 serve to receive the longitudinal stem 23 of L-shaped pin 20, the pin further including an integral handle 25 positioned and sized to fall outside spaced legs 21 of bracket 19. The extremity of stem 23 extends through the upper aperture 22 serving as a pin end follower 23' (FIG. 7) which is adapted to ride between, semi-spherical, parallel spaced outer track legs 14 of track member 13. A helically wounded spring 24 is positioned to surround pin stem 23 between stop 50 extending normally through an aperture in stem 23 and one of outer legs 21 of support bracket 19. Support bracket 19 is so positioned relative semi-spherical track member fastened to the opposed proximal base leg 11 of truss assembly 9 to spring load the stem end 23' of pin 23 against the semi-spherical base leg 16 of track 13 as it moves between the semi-spherical spaced parallel outer track legs 14 of track member 13 until the stem end 23' of pin 23 is automatically urged into locked position in the preselectively positioned aperture 17 of the semi-spherical base leg 16. This aperture 17 is so positioned at the extremity of base leg 16 of track 13 as to automatically be lock engaged with the end 23' of pin stem 23. This occurs when the mirror-image related U-shape tubular truss members 9 and 9' have been fully pivoted outwardly about opposed corresponding vertical uprights of ladder frames 3 from a scaffold collapsed position to substantially fall in end-to-end alignment within a common plane when the scaffold is in expanded position. In this regard, it is to be noted in FIG. 1 of the drawings that the pivotally joined and locked U-shaped truss frame members 9 and 9' of truss assembly 8 are sized to extend substantially normally from the rung ladder frames in such substantial end-to-end alignment within a common plane when in the expanded, locked position.

Figure 8:
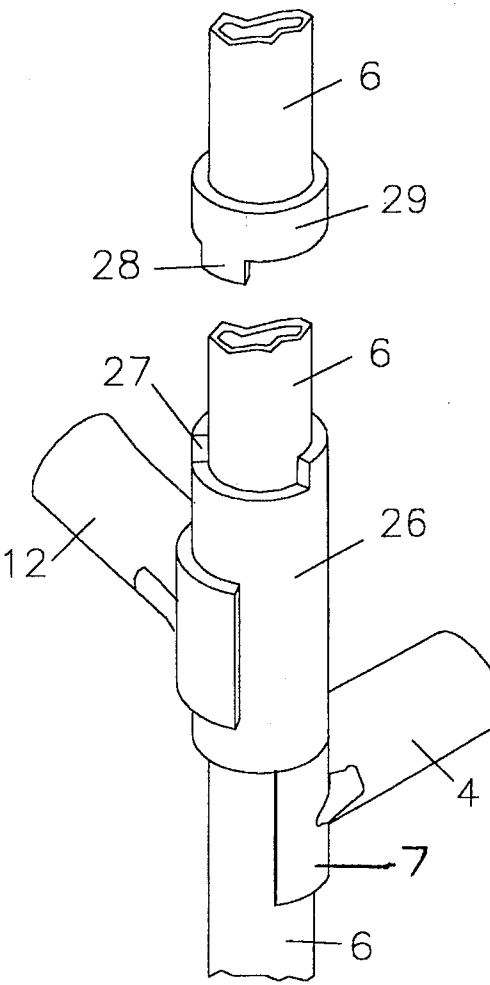
FIG. 8 is an enlarged, partially exploded and broken away isometric view of a portion of the truss assembly and vertical upright of a ladder frame, disclosing the novel structural tongue and slot arrangement for restricting the angle of pivotal movement of the truss assembly relative the ladder frame.
Figure 9:
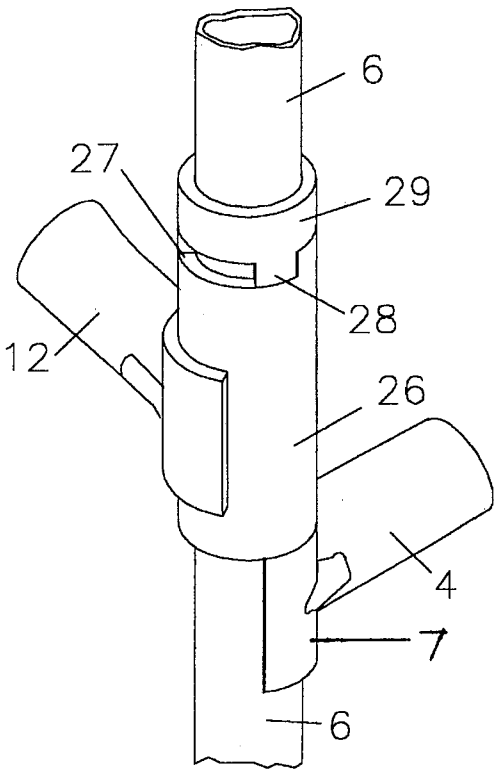
FIG. 9 an enlarged, isometric view of the structure of FIG. 8 in assembled position; and, FIG. 10 is an enlarged, partially broken away, isometric view of structure similar to that of FIG. 9 which further can include a protective shield arrangement to be utilized with the tongue and slot structure of FIGS. 8 and 9.

In accordance with still another feature of the present invention and as can be more fully seen in FIG. 1, and in more detail, in FIGS. 8 and 9 of the drawings, the opposed outwardly extending legs 12 and 12' of each U-shaped tubular frame 9 and 9' respectively can have the corresponding distal end extremities thereof pivotally mounted in spaced relation to a spaced pair of correspondingly vertically extending tubular uprights 6 of spaced tubular ladder rung frames 3, each mounting of each pair of legs 12 and 12' being accomplished through a spaced pair of intermediate telescopically and pivotally mounted, vertically extending tubular segmental collar portions 26. Each of the pair of two spaced, segmental vertically extending tubular portions 26 are pivotally positioned on one of each of two corresponding tubular spaced uprights 6 to accommodate pivotal movement of the tubular segmental portions 26 and truss frame members 9 and 9' with the extremities of legs 12 and 12' respectively welded and fastened thereto, such pivotal movement being with respect to the relatively fixed portions of their respective vertical uprights 6.

Still referring to FIGS. 8 and 9 of the drawings, a further novel feature of the present invention is disclosed. In these drawings, it can be seen that at least one pivotable tubular segmental portion 26 of each upright 6 can be provided with a horizontally extending, peripheral slot 27 at at least one extremity therein. Slot 27 can be peripherally sized to allow a preselected degree of vertical axial rotation of pivotal segmental portion 26—advantageously ninety (90) degrees—relative a tongue 28 interlocked therewith. Interlocking tongue 28 is part of collar ring 29 selectively fixed to vertical upright 6 of rung ladder frame 3 to which truss frame members 9 and 9' of truss assembly 8 are mounted. It is to be understood that similar tongue and slot arrangements can be provided on the opposite vertical uprights 6 to which the truss frame assembly members 9 and 9' are mounted. Further, such tongue and slot arrangements can be utilized with both spaced tubular segmental portions 26 on each vertical upright 6 and, if desired, can even be included at both extremities of each segmental portion. The tongue and slot arrangements serve to restrictively allow inward and outward pivotal movement of U-shaped tubular frames 9 and 9' of truss assembly 8 through the preselected peripheral length of the slot, this in turn being selectively adjusted with the positional location of aperture 17 in the semi-spherical base leg 16 of semi-spherical track member 9. It will be noted that when the truss-assembly 9 and 9' have been pivoted to fully expanded position, the tongue 28 and slot 27 aforedescribed permits no further outward pivotal movement of the truss assembly and that the end 23' of pin 23 is automatically spring urged into locked position in aperture 17.

Figure 10:
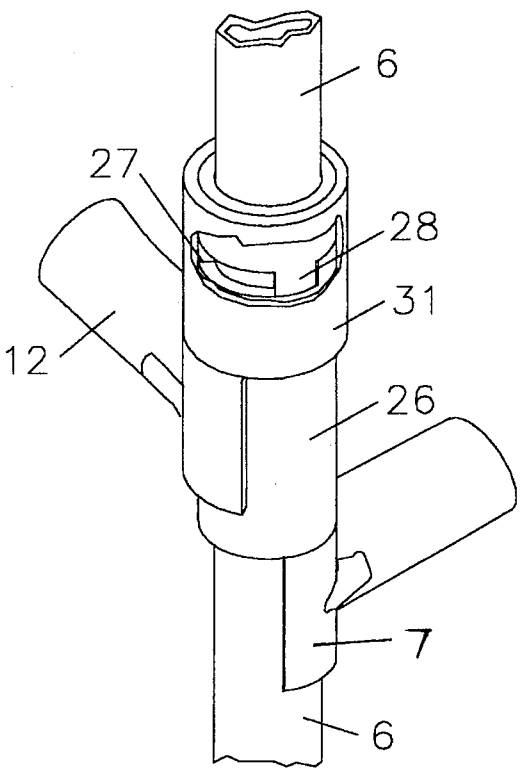

Referring to FIG. 10, still another feature of the present invention is disclosed in the form of a protective collar shield 31 which can be utilized to surround the interlocking slot 27 and tongue 28 to restrict inadvertent access thereto. It is to be understood that protective collar shield 31 can be fixedly mounted directly to pivotal segmental portion 26, or to relatively fixed upright 6, or can, if desired, even be an outer part of the tongue and ring assembly 28,29. Further, the slot and tongue arrangement 27,28 aforedescribed can be reversely positioned, if so desired.

Figure 2:
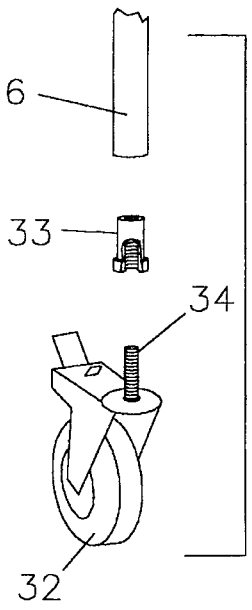
FIG. 2 is an enlarged, exploded view of one of the novel caster arrangements of FIG. 1.

Again referring to FIGS. 1 and 2 of the drawings still a further feature of the present invention can be seen particularly in the enlargement of FIG. 2. In this FIG. 2, one of the identical casters 32 of the set of four casters as shown in FIG. 1, can be seen in an exploded, isometric enlarged view in association with a base portion of its hollow, tubular vertical upright 6. The base of each hollow upright 6 is arranged to snugly receive therein a plug 33. Plug 33 can be appropriately sized to engage snugly in the base of tubular upright 6 and advantageously can be formed from a suitable powdered metal which subsequently is threadedly tapped internally so as to threadedly engage with the threaded stem 34 of caster 32. Thus, with this threaded powdered plug and threaded caster stem structure, a stable yet economical to manufacture, assembly and disassembly caster structure is provided.

Figure 4:
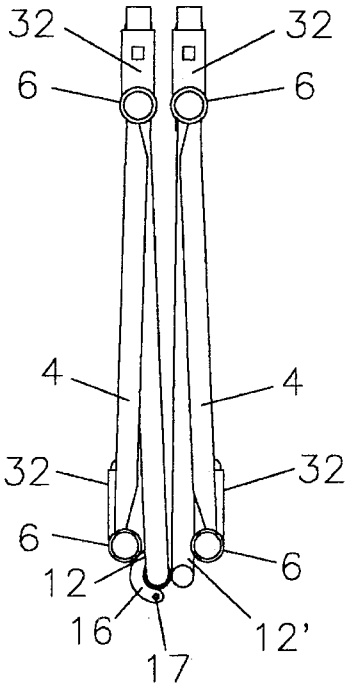
FIG. 4 is a top view of the scaffold of FIGS. 1–3 in collapsed position with the support planks removed.
Figure 3:
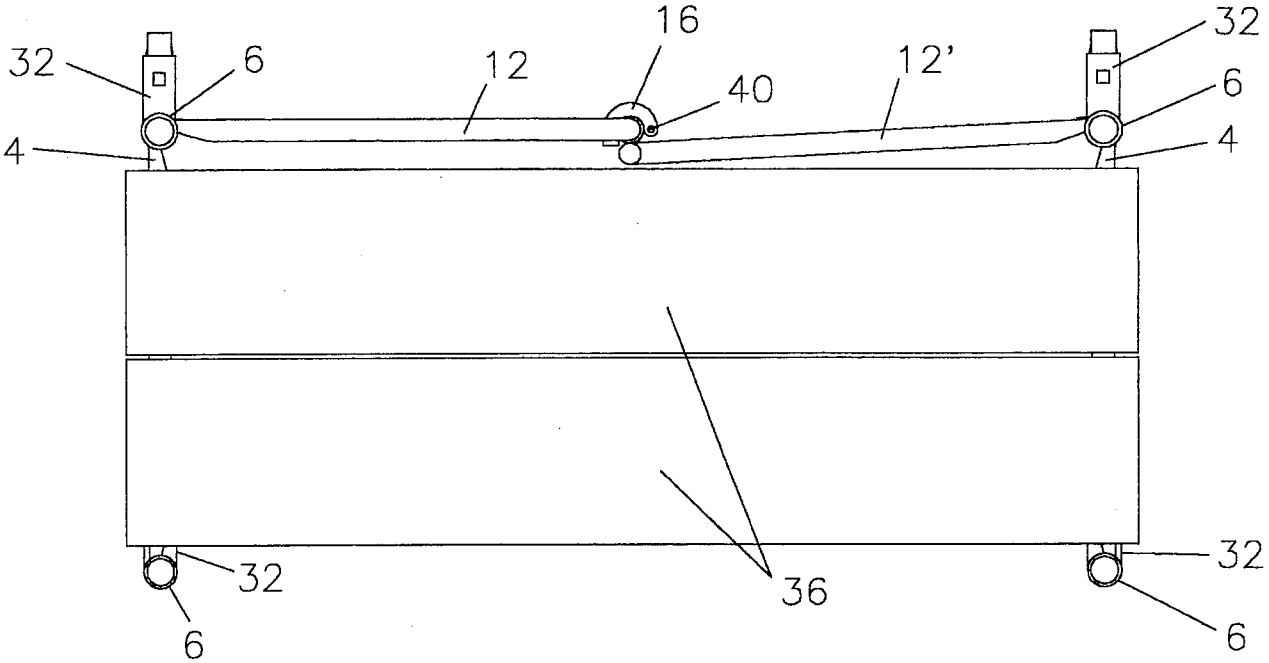
FIG. 3 is a top plan view of the expanded scaffold and side-by-side support planks of FIG. 1.

As also can be seen in FIGS. 1,3 and 4 of the drawings, at least one support platform 36 and advantageously two platforms 36 can be assembled with the scaffold 2 when in extended, expanded position. Platform 36, advantageously can be formed from a light, strong, metallic or equivalent material, Suitably sized in width and length to supportively extend between the rungs of expanded scaffold 2. In this regard, the platforms 36 can be sized in width so that more than one platform can be positioned on the same pair of opposed rungs and that, if desired, several platforms can be utilized to extend across each pair of opposed, corresponding rungs of each set of rungs so as to utilize the scaffold 2 for shelved storage. It is to be noted that platform 36 can be of U-shaped cross-section with the ends of the spaced outer legs thereof having notches 37 to engage selective rungs of the spaced rung ladder frames 3 when the scaffold 2 is, in expanded position, further restraining outward movement of the ladder frames 3.

To move the scaffold 2 to collapsed position, (FIG. 3), it only is necessary to remove all platforms 36 mounted thereon, pull the pin handle 25 to disengage the end 23' of spring loaded stem 23 from aperture 17 and move the rung ladder frames 3 and associated pivotal truss frame members 9 inwardly. In this regard, it is to be noted that in addition to the aperture 17 provided at one end of base 16 of track 13, the aforedescribed similar aperture 40 (FIGS. 3 and 7) can be provided at the opposite end of base 16 to hold the scaffold 2 in locked position.

From the above description, it can be seen that a novel collapsible-expansible scaffold structure is provided to include numerous structural features heretofore unknown in the structural support art, the novel structure being straightforward and economical to manufacture, assemble and disassemble with a minimum of parts and with a maximum of stability and utility.

The invention claimed is:

1. A collapsible-expansible support assembly comprising:

a pair of vertically extending rung ladder frames, said ladder frames being adapted to be moved apart in expanded spaced, substantially parallel relation so that the rungs thereof can receive at least one support platform to be mounted thereon; a moveable collapsible-expansible truss assembly including opposed spaced remote distal ends pivotally mounted respectively to said ladder frames and adjacent proximal ends pivotally joined to each other; and, a unitary guide tract and pin assembly restricting and holding means cooperative with and between said pivotally joined proximal ends to automatically releasably lock and immobilize said collapsible-expansible truss assembly in at least one firm and immovable preselected position until intentionally released when said truss assembly has been moved to such preselected position.

2. The collapsible-expansible support assembly of claim 1, said holding means automatically releasably locking said truss assembly when in preselected fully expanded position.

3. The collapsible-expansible support assembly of claim 1, said holding means automatically releasably locking said truss assembly when in a preselected collapsed position.

4. The collapsible-expansible support assembly of claim 1, said holding means including a spring loaded pin member cooperatively mounted on one of said pivotally joined proximal ends of said collapsible-expansible truss assembly and a preselectively apertured, track member cooperatively mounted on the other of said pivotally joined proximal ends of said truss assembly to resiliently receive and automatically guide the extremity of said spring loaded pin member into an aperture therein to automatically releasably lock said proximal ends in a preselected position.

5. The collapsible-expansible support assembly of claim 1, said vertically extending ladder frames including vertical uprights of a hollow tubular nature, each opened at the bottom end thereof to snugly receive a caster plug internally conformed to receive a caster stem in mated male-female relationship.

6. The collapsible-expansible support assembly of claim 5, further including a caster plug of powdered metal having a female receptacle with an appropriately sized internal threaded tap; and, a caster roll assembly including an externally threaded caster stem to matingly engage with said internal threaded tap.

7. The collapsible-expansible support assembly of claim 1, said vertically extending ladder frames including vertical uprights with those vertical uprights to which said remote distal truss ends of said truss assembly are pivotally mounted including fixed stop collar limiting means to limit the amount of pivotal rotation of said truss assembly relative thereto.

8. The collapsible-expansible support assembly of claim 7, said vertical uprights to which said remote distal truss ends of said truss assembly are pivotally mounted each, including an intermediately mounted collar rotatively pivotable about its longitudinal axis relative the longitudinal axis of said vertical upright with at least one extremity of said rotatively pivotable collar interlocking in a slot and tongue arrangement with said adjacent fixed stop collar limiting means, the slot and tongue arrangement being sized to allow a preselected degree of relative pivotal movement of said interlocked collars.

9. The collapsible-expansible support assembly of claim 8, and a protective skirt fixed to one of said interlocked collars to protectively shield inadvertent access to said relatively movable slot and tongue arrangement.

10. The collapsible-expansible support assembly of claim 1, and a support platform notched and positioned to engage selective rungs of said spaced rung ladder frames further restraining movement therebetween.

11. The collapsible-expansible support assembly of claim 1, wherein said adjacent proximal ends are pivotally joined to each other by pivot tube means fastened to one of said proximal ends to pivotally accommodate said adjacent proximal end passing therethrough.

12. The collapsible-expansible support assembly of claim 11, and stop means to limit possible linear movement of said pivot tube means.

13. The collapsible-expansible support assembly of claim 12 wherein said stop means includes a spaced pair of pivot tubes spaced a sufficient distance to only accommodate said restricting and holding means therebetween.

14. A collapsible-expansible scaffold support assembly comprising: a pair of vertically extending rung ladder frames, each frame including a set of horizontally spaced hollow tubular rungs and a pair of spaced vertically extending tubular uprights with opposed extremities of said spaced rungs being of arc-like shaped form to overlap a portion of a tubular upright for welding thereto; a moveable collapsible-expansible tubular truss assembly including a pair of corresponding, mirror-image positioned substantially U-shaped tubular frame members, each U-shaped tubular frame member including a base leg serving as the proximal end thereof with opposed legs of each such U-shaped tubular frame extending outwardly at an angle from the base legs, said U-shaped tubular frame members having their proximal base legs in parallel pivotally adjacent relation with each other with one base leg proximal end of one U-shaped tubular frame member having a semi-spherical track-member of U-shaped cross-section mountedly extending therefrom, said track member including a semi-spherical base leg with spaced outer semi-spherical side legs extending from the outer longitudinal edges of said base leg with said semi-spherical base leg of said track member resting in an horizontal plane and including at least one aperture at one extremity thereof with said semi-spherical base leg and outer semi-spherical spaced side legs thereof extending therefrom serving as guide tracks for a pin end follower, the proximal adjacent base leg end of the other U-shaped tubular frame member having fixed thereto the base leg of a U-shaped spring -loaded pin support bracket, said U-shaped bracket including a base leg and spaced side legs having spaced aligned apertures with an L-shaped pin follower mounted to slidably extend between said spaced aperture—aligned outer legs extending normally from the base leg of said support bracket to be spring loaded by a helical spring surrounding said pin follower and extending between said support bracket outer legs between a pin stop member and one of said outer legs, said support bracket being so positioned relative said track that the end of said slidable pin follower rides in spring loaded fashion against said semi-spherical base leg of said semi-spherical track between the outer legs of said track until it is automatically urged into locked position in the aperture at the extremity of said semi-spherical base member of said track when said U-shaped tubular frame members are fully pivoted outwardly from scaffold collapsed position to substantially fall within a common plane when said scaffold is in expanded position, said pivotally joined U-shaped tubular frame members being sized to extend normally from said ladder frames in said common plane expanded position with the opposed distal leg ends of each tubular frame being pivotally mounted in spaced relation to a corresponding vertically extending tubular uprights of said spaced tubular ladder rung frames through an intermediate rotatively pivotal telescopically mounted tubular collar on said vertically extending upright which tubular collar is telescopically pivotable about its longitudinal axis relative the longitudinal axis of said vertical tubular upright with at least one longitudinal extremity of said rotatively pivotable collar having a slot herein peripherally sized to allow a substantially ninety (90) degree rotation about a tongue interlocked therein, said tongue extending from an adjacent relatively fixed collar so as to restrictively allow an approximately ninety (90) degree outward and inwardly relatively pivotal movement of said U-shaped tubular frames when in expanded and collapsed positions respectively, each of said vertically extending tubular uprights of each ladder frame having an internally female threaded powdered metal plug snugly inserted in the base thereof, a set of removable casters, each with a male threaded stem adapted to be screwed into each powdered metal plug; and at least one support platform of U-shaped cross section with the ends of the spaced outer legs thereof notched at suitable spacing to engage selective rungs of said spaced rung ladder frames when in expanded position.

* * * * *